US005804958A

United States Patent [19]

Tsui et al.

[11] Patent Number: 5,804,958

[45] Date of Patent: Sep. 8, 1998

[54] SELF-REFERENCED CONTROL CIRCUIT

[75] Inventors: Mung Laam Tsui, Hong Kong; Kin Keung Lau, Kowloon, both of Hong Kong

[73] Assignee: Motorola, Inc., Schaumburg, Ill.

[21] Appl. No.: 875,000

[22] Filed: Jun. 13, 1997

[51] Int. Cl.[6] ..... G05F 3/16

[52] U.S. Cl. ..... 323/313

[58] Field of Search ..... 323/313, 907

[56] References Cited

U.S. PATENT DOCUMENTS

| | | | |
|---|---|---|---|
| 4,339,707 | 7/1982 | Gorecki | 323/313 |
| 4,628,247 | 12/1986 | Rossetti | 323/314 |
| 5,410,241 | 4/1995 | Cecil | 323/315 |
| 5,545,970 | 8/1996 | Parkes, Jr. et al. | 323/277 |
| 5,585,749 | 12/1996 | Pace et al. | 327/108 |
| 5,675,243 | 10/1997 | Kamata | 323/313 |
| 5,732,028 | 3/1998 | Shin | 323/313 |

*Primary Examiner*—Stuart N. Hecker
*Attorney, Agent, or Firm*—Rennie William Dover

[57] ABSTRACT

A voltage control temperature compensated circuit for coupling to a supply that provides a supply voltage at first (102) and second supply nodes (103) and the voltage control circuit for generating and regulating an output voltage (VREG). The voltage control circuit includes an output device (18) coupled to the first and second supply nodes for generating the output voltage and a base coupled bipolar pair controller (15 and 14) coupled to the first and second supply nodes for generating an internal high-side (106) voltage reference (104) and for regulating the output voltage to compensate for changes from the desired response between the output voltage and the internal reference voltage.

20 Claims, 4 Drawing Sheets

—PRIOR ART—

SELF-REFERENCED CONTROL CIRCUIT

TECHNICAL FIELD

This invention relates in general to control circuits, and more particularly to improved temperature compensated automatic output control circuits such as control circuits for voltage regulation below 0.7V on an integrated circuit chip to internally provide the regulated voltage reference as a voltage regulator, a switch driver, or another type of regulated controller.

BACKGROUND OF THE INVENTION

Applying a reference voltage to an automatic output control circuit for maintaining a particular voltage level is well known in the electronic arts. It is well known in the arts that a voltage control circuit is basically a comparator that compares a voltage reference and a voltage proportional to an output voltage from the voltage control circuit to develop an error or feedback signal. The error signal is amplified by a direct current (DC) amplifier and then used to drive the output voltage to a predetermined level, thereby forming a closed loop system. To maintain a precise voltage regulation throughout a normal range of output currents, such as load currents or driver control currents, which the voltage control circuit must supply during operation, a predetermined loop gain is desired.

Known voltage control circuits have used a bandgap reference Vext-ref which consumes space and an emitter-coupled bipolar transistor pair as a differential amplifier with an npn low-side bipolar current source device to set-up the tail current I, as seen in the differential amplifier of FIG. 1. However, the performance of the emitter-coupled pair and bandgap reference Vext-ref may degrade over low voltage levels, such as being incapable of detecting or regulating voltage levels below the bipolar base-emitter voltage Vbe of approximately 0.7V, and especially over a wide temperature range. As is known, the base-emitter voltage Vbe could range from 0.9V to 0.5V over a 200 degree C. temperature range because the temperature coefficient (TC) is −2 mV/degree C., assuming a room temperature Vbe of 0.7.

By definition, a voltage control circuit is for maintaining an output voltage at a predetermined value regardless of normal input-voltage changes or changes in the load impedance of the output load. The Power Supply Rejection Ratio (PSRR) is a figure of merit showing how well the control circuit performs against supply variation. The prior-art differential amplifier is incapable of regulating to a voltage below or even approaching 0.7V because when the regulation voltage is approaching 0.7V, the power supply rejection ratio PSRR (the effect of supply voltage ripple on the regulation voltage) worsens. Since PSRR is directly proportional to the output impedance of the tail device, the output impedance of the regulator is degraded because of the variance of the resistive bipolar tail device I as the bipolar tail device becomes saturated or resistive below the Vsat operating point. As is known, Vsat is the voltage below which the device, no matter bipolar or MOS starts to work in the left-most ramping resistive region of the operating curve. It is the drain-source voltage (Vds) in the MOS case and collector- emitter voltage (Vce) in the bipolar case. For a bipolar device, Vsat is around 0.3V.

As an example, if the voltage at the base or regulated voltage node of the emitter coupled differential amplifier is desired to be regulated to 0.8V, there is only 0.1V remaining across 1, after satisfying the 0.7V base-emitter voltage Vbe (neglecting the Vbe temperature variance) of the transistor to turn the transistor ON. With such a voltage of 0.1V less than the required 0.3V for Vce(sat), the bipolar tail device will work in the resistive region or saturation region of the bipolar device. The prior-art circuit will thus have a degraded PSRR due to the resistive I. Hence, the base or regulated node has to be higher than Vbe2+ Vsat to ensure that the voltage across I is larger than Vsat, to prevent I from saturating or becoming resistive. For the bipolar prior-art circuit, this means that the regulated or base voltage cannot be below 1.0V (0.7+0.3=1.0 where bipolar Vsat=0.3). Therefore, previously, voltages could not be regulated below 1.0V.

Accordingly, there is a need to provide an improved temperature compensated automatic voltage control circuit that accurately maintains the desired voltage setting at low levels and across the temperature range. As electronic components become smaller and integrated on the same monolithic integrated circuit, the deletion of a bandgap reference is also desirable to save space.

DETAILED DESCRIPTION OF THE PREFERRED EMBODIMENT

Potential applications for the inventive control circuit include controlled turn-ON voltage switching applications and low voltage (<1 v) regulation control. Referring to FIGS. 2–5, the teachings of the present invention can be used in a low-side switch driver for switching applications as in FIGS. 3–4, in a regulator of a supply source having a regulated or unregulated voltage source as in FIG. 5, or in any other suitable control circuits, generally depicted by FIG. 2. The desired voltage at an output terminal 170 is to be regulated to a voltage below 0.7V and this regulated voltage should be temperature independent and self-referenced.

Figure 3:
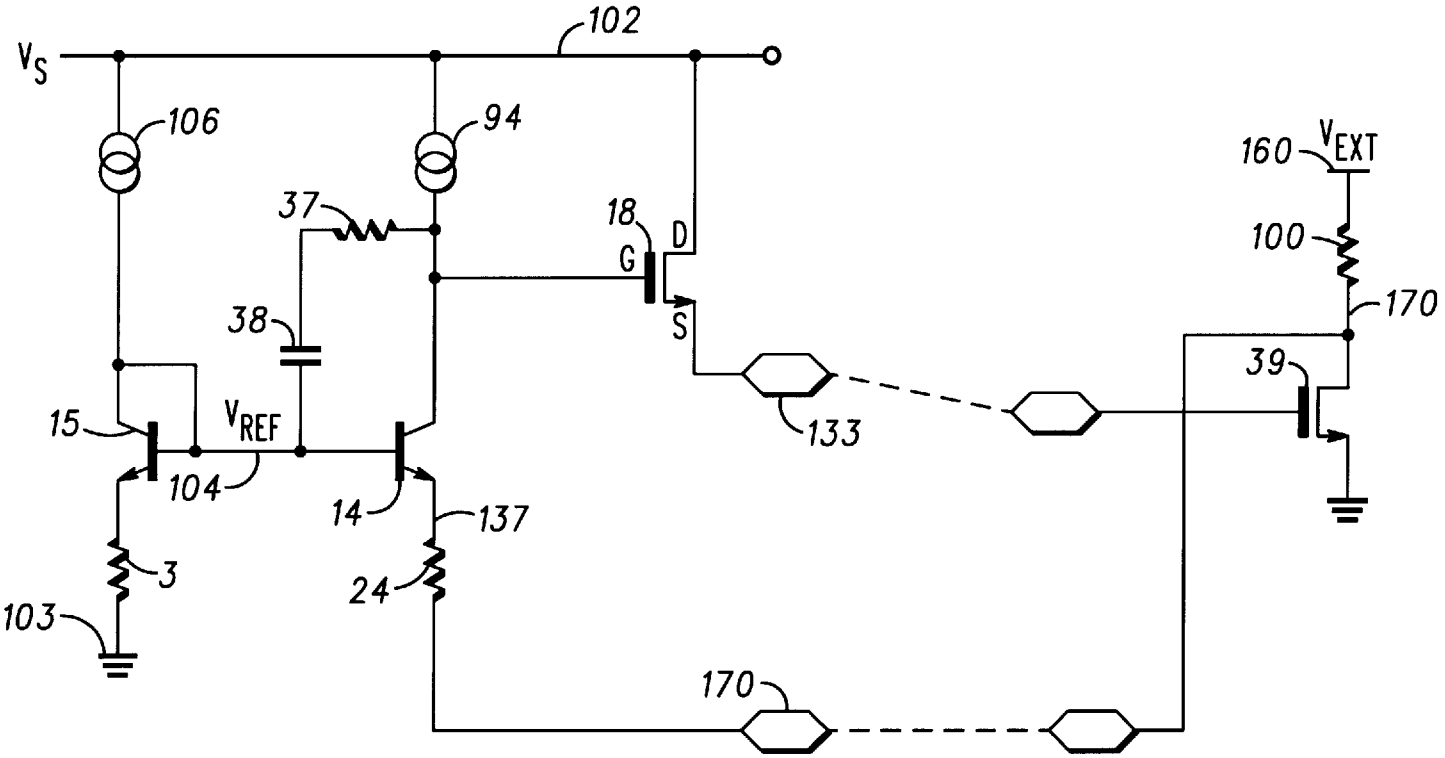
FIG. 3 is a circuit diagram of the control circuit of FIG. 2, in a switch driver application, in accordance with the present invention.
Figure 4:
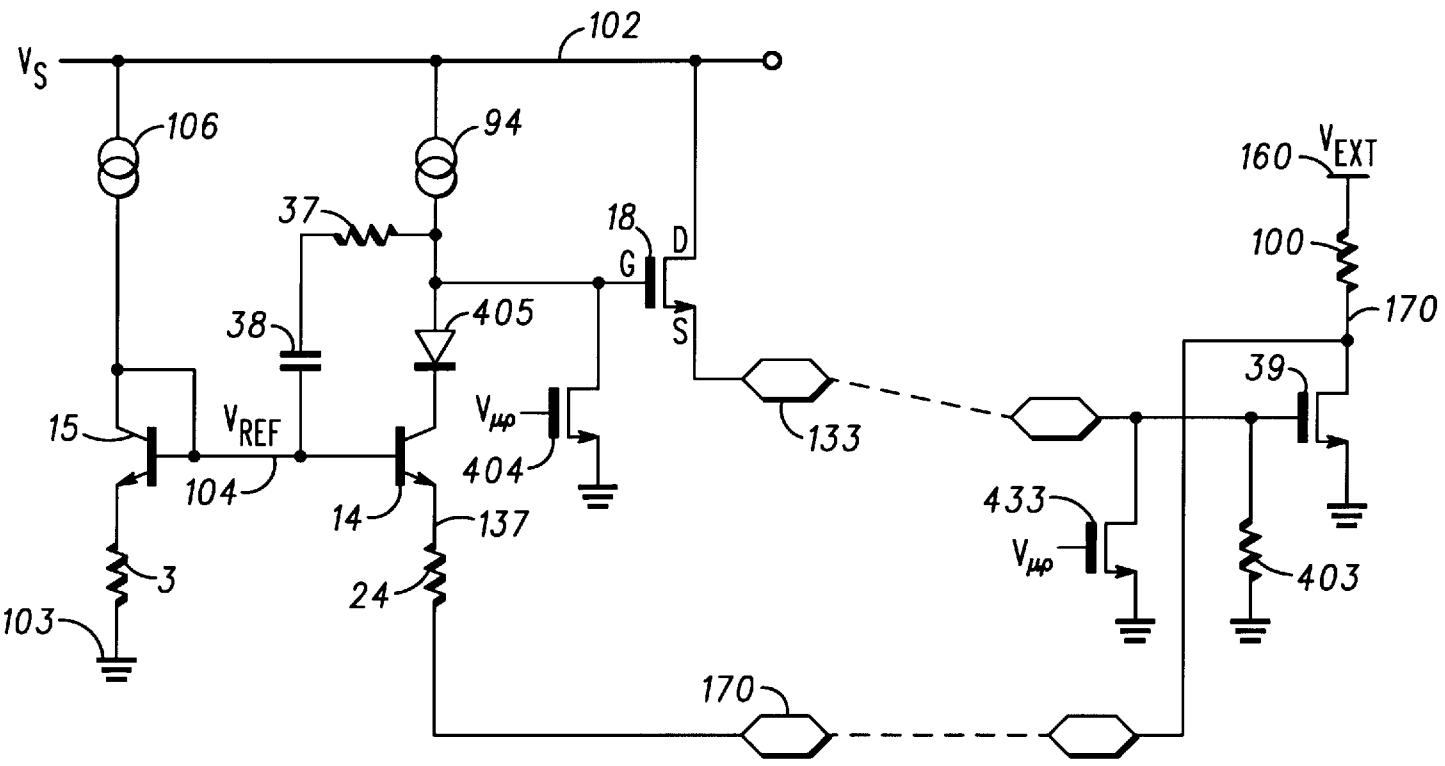
FIG. 4 is a circuit diagram of the switch driver circuit of FIG. 3, with additional switching elements, in accordance with the present invention.

As in FIGS. 3–4, the present invention can be used as a driver to drive or otherwise control a switching load transistor 39 in a switching application where an electrical drive is provided and feedback compensated through a node 133. Examples of low-side switching applications where constant turn-ON voltages over temperature are desired are ink jet printers and lamp drives in automobiles. For example, the lamp drive can be used for fault detection by car alert-indicators. An example of a car alert-indicator can be a warning lamp which is turned-ON when there is some problem detected in the car.

Specifically, the self-referenced regulator of the present invention is used for the fault lamp switch. When a fault is detected in the car, such as a low battery voltage, the car's dashboard indicator light will turn ON. The light bulb serves as the load 100 of the inventive circuit where the light switch turn-ON voltage is desired to be fixed at 0.7V.

Figure 1:
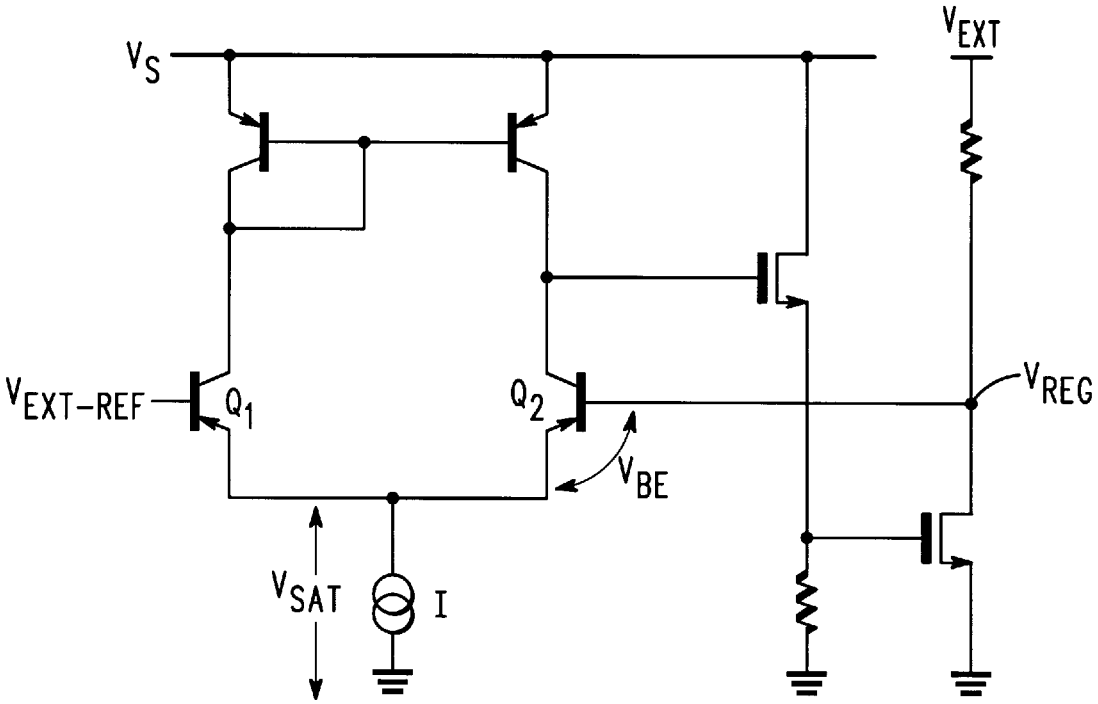
FIG. 1 is a prior-art circuit diagram of a control circuit.
Figure 2:
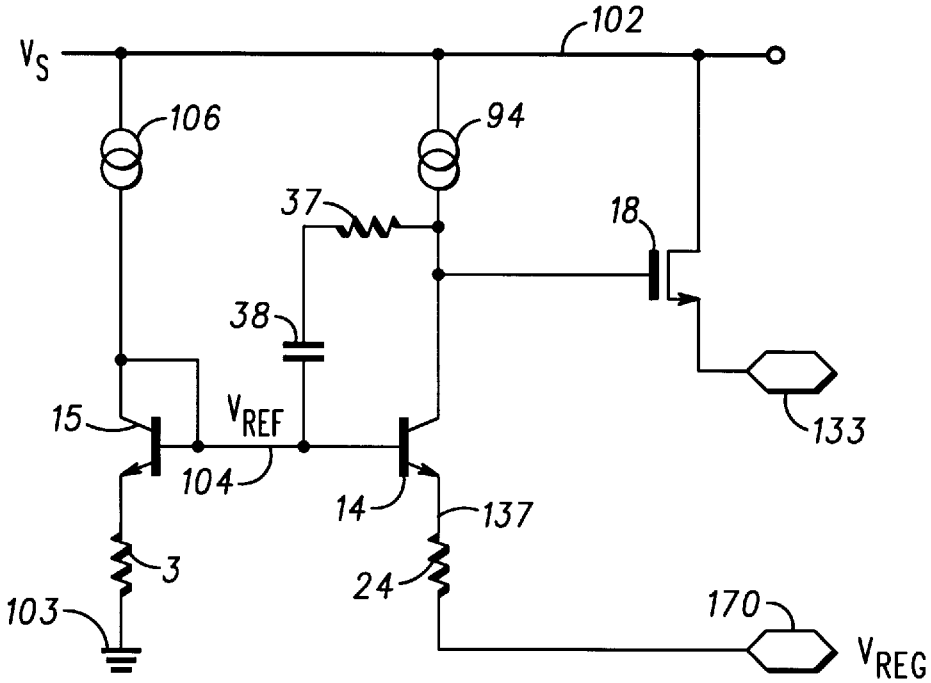
FIG. 2 is a circuit diagram of a control circuit, in accordance with the present invention.

Referring to FIG. 2, an electrical block diagram depicts a voltage control circuit coupled between first and second supply terminals or nodes 102 and 103. Node 102 is also the supply voltage node or positive rail for supplying a previously regulated or unregulated supply voltage Vs. The control circuit includes a common-base coupled bipolar comparator or some other kind of controller for comparing an internal reference voltage and a representative of the detected output voltage at the output terminal proportional to the output voltage of the voltage control circuit to produce a feedback signal representative of the output voltage having an error or other differences from the desired regulated output voltage below 0.7V.

The comparator includes two high-side mirrored current zero temperature coefficient (TC) sources 94 and 106, adapted from a source or supply voltage available at the first supply node or terminal 102 in a current source stage. The current source stage is coupled to an internal reference for setting a level of current through the comparator. Generating a zero TC current source is a well known technique in integrated circuit (IC) design. A zero TC current source generator provides a zero TC reference current which is copied by all the other circuits, such as the two current sources 94 and 106, in the chip that needs a zero TC current source. Hence the two "head" currents set by the two high-side mirrored current sources 106 and 94 are identical. Furthermore, because the location of the current source 94 is above the voltage regulation point 170, in providing such "head" currents, as opposed to the prior art "tail" current I, the Vsat of the current source does not limit the minimum voltage regulation setting in providing a high PSRR regulation loop. Hence, the common based configured transistor 14 advantageously allows the high-side input supplied voltage to the low-side switch 39 to be connected from the bottom of the voltage regulator circuit to produce a high PSRR regulation loop even for a low regulation voltage of below 0.7V.

Together with the transistor 14, another similar NPN transistor 15 form the common-base coupled bipolar comparator. Both transistors 14 and 15 have their collectors connected to the first supply node 102 at a positive rail for receiving a positive supply voltage via the two current sources 94 and 106 respectively. The diode-connected NPN bipolar transistor 15 has its collector connected to its base and to the current source 106. The base of the other transistor 14 is coupled to the base of the diode-connected transistor 15. The emitters of the first and second (arbitrarily labeled as first and second for simplicity) transistors 15 and 14 are connected to a second supply or another common terminal node 103 (circuit ground or negative rail) by way of emitter elements. The emitter element coupled to the transistor 15 is a resistor 3 or another type of impedance. For a driver switch application, the emitter elements are a resistor 24 and a low-side switch 39.

Operationally, transistors 15 and 14 form a base coupled amplifier that has its bias set at their commonly connected base by the current source 106 to serve as an internal voltage self-regulated voltage reference. The collector currents are set by the current sources 106 and 94. Since the transistors 14 and 15 share the same base voltage and have the same collector current flowing through them, transistors 14 and 15 will also have the same emitter voltage because the collector current is governed directly by the base-emitter voltage of the bipolar junction transistor:

$$Vbe=VTIn(Ic/Is) \quad (1)$$

For self-referencing and temperature independence, the comparator is formed firstly by a reference voltage source for providing an internal fixed high-side amplifier bias at a temperature dependence of a predetermined polarity and secondly by a temperature control circuit compensator having a temperature dependence of the same predetermined polarity and a receiving port for receiving the internal fixed high-side amplifier bias. The internal reference voltage source thus includes the transistor 15, the resistor 3, and the zero TC current source 106.

The current from the current source 106 flows to the transistor 15, to the emitter resistor 3, and finally to ground to provide an internal temperature reference to the base of the common-based transistor 14 for basing the regulated voltage upon. In turn, the regulated voltage is a function of the base emitter voltage (Vbe) of the resistor 3 and the voltage developed across the resistor 3 by the current flowing through the resistor 3. As shown in the Kirchhoff voltage loop circuit of FIG. 2, the voltage reference and fixed bias base voltage is equal to the base-emitter voltage Vbe of the diode-coupled transistor 15 plus the voltage developed across the diode-coupled transistor emitter's resistor 3 by the current source 106. Hence, the bias voltage at the base node of the second amplifier or transistor 14 is fixed at Vb14 for connecting to an internal voltage reference signal (VREF) at a voltage reference node or built-in reference voltage point (which is not temperature compensated) 104 for determining the output voltage of the voltage control circuit:

$$VREF=Vb14=Vbe15+I106R3 \quad (2)$$

However, in normal variations of semiconductor bipolar processing, the base emitter junction voltage Vbe of a bipolar transistor is a function of the saturation current of the bipolar transistor Is as seen in equation 1 which can vary over temperature.

The temperature cancellation is done by the temperature control circuit compensator. The compensator includes the resistor 24 having a value R24, and a second temperature coefficient for forming an impedance ratio as a function of a temperature coefficient ratio, wherein the impedance ratio comprises the ratio of the first impedance value R3 over the second value R24 and the temperature coefficient ratio comprises the ratio of the second temperature coefficient over the first temperature coefficient for canceling out the temperature dependence due to the voltage reference. The compensator also includes the transistor 14 coupled to the first end of the resistor 24 for providing a compensation reference as a function of the base-emitter voltage. The second end of the resistor 24 forms the output terminal, regulation voltage point, or regulator input 170 for providing the output terminal voltage to an external load. The desired output terminal voltage is called the regulation voltage and can be summed from the Kirchhoff voltage loop where the following equation can be set-up:

$$VREG=Vbe15+I106R3-Vbe14-I94R24. \quad (3)$$

After canceling out the similar base-emitter voltage terms and factoring out an assumed common current I94, a simpler voltage regulation equation exists:

$$VREG=I94(R3-R24) \quad (4)$$

By taking the derivative of equation 4 to form the temperature coefficient and setting it to zero, the following relationship results to achieve a zero temperature coefficient at the corresponding regulation voltage:

$$R3/R24=TC(R24)/TC(R3) \quad (5)$$

Thus the base voltage of the diode-connected transistor 15 can be tuned or matched to have about a zero temperature dependence.

Hence, according to the teachings of the present invention, the pair of resistors 3 and 24 from equation 5 can set up the regulation voltage (based on the base node fixed reference of Vb14=Vbe15+I106R3 of equation 2) to almost any value depending on the voltage supply and the switch saturation voltages. The reference regulation voltage VREG was given in equation 4 as I94(R3=R24). By playing with different values for I94, R3, and R24, the circuit can basically achieve any value, even below 0.7V. For example, if a 0.4V regulation voltage is desired and R3 is a type of resistor that has a temperature co-efficient (TC) of 2000 ppm while R24 has a TC of 4000 ppm, R3=2K, R24=1K, then equation 4 becomes 0.4=I94(2K−1K). Solving for the unknown current I94 yields I94=400 $\mu$A which can be easily realized as a zero TC current source. With the two resistor values R3 and R24 in a 2 to 1 ratio, and the same biasing current 106 and 94 flowing through them, the regulation voltage can be self-regulated at a desired voltage below 0.7V to operate an external load. Since the conditions required in equations 4 and 5 have been fulfilled, a 0.4V zero TC regulation reference voltage can be achieved.

Ideally, the semiconductor fabrication process that allows for the proper setting-up of the voltage regulation ratio will have the inventive control circuit laid-out all on one integrated circuit chip, thus having the same physical properties for proper temperature tracking. With the proper lay-out matching of both transistors 14 and 15 integrated with the same material, positioned in close proximity and in the identical orientation, parameters drift of these elements will move in the same direction and therefore will cancel each other. Hence, a low regulation voltage can be regulated which is not limited by the additional prior-art Vsat minimum voltage requirement of Vsat to provide a high PSRR regulation loop.

Even though the bias voltage is fixed, once predetermined or otherwise set, the range of the desired fixed voltage for biasing the base of the transistor 14 depends on what regulation voltage is desired. Hence the voltage at the base of transistor 14 should be set by the following equation:

$$Vb14=VREG+Vbe14+I94R24 \quad (6)$$

The second transistor 14 acts as a transconductance amplifier or voltage-current converter in a common base configuration, commonly called a common base amplifier in conjunction with the second current source 94. Using a common-base configuration such that the base of the bipolar transistor 14 is biased at the fixed voltage VREF of equation 2, the emitter of the current controlled bipolar transistor 14 is used as the voltage input of this transconductance amplifier where the output current supplied is proportional to its input voltage. The collector of this transconductance transistor 14 in this configuration has an ultra high output impedance which is incapable of sourcing a large current directly. By connecting the collector of the transconductance transistor 14 to the output of the second current source 94 at the collector, which is a high impedance node, a gain stage is constructed because the voltage gain of a node is equal to the transconductance (the change of output current change with respect to the input voltage change) multiplied by the node impedance.

For the switch application, the common base-coupled amplifier thus formed by the diode-connected transistor 15 and the transconductance transistor 14 is used to adjust a third amplifier 18, acting as a pass transistor in the active region, for controlling an output current. For feedback compensation, the output of the third transistor 18 will adapt itself, as controlled by the transconductance transistor 14, to the input current or voltage required by an output load device.

Referring to FIG. 3, the transconductance or second amplifier 14 acts as a load output controlling transistor for the third amplifier 18. The third amplifier 18, in turn, acts as a driver or a high-side active device 18 for forming a buffer in a driver switch application. At its output or source node 133, the third amplifier 18 provides a low-side single ended drive control signal in the form of a bias or gate input to drive a large switch or a large pass element. In this case, it is a fourth amplifier or transistor 39, acting as an off-the-chip external low-side switch 39 to drive an external load. Alternatively, it could be more economical to integrate a power switch 39 internally to save on total system costs.

As for the buffer, the output port or source of the third transistor 18 is connected to the bias port of the fourth amplifier 39, while the input port or drain of the third transistor 18 is connected to the first supply node 102. The bias port or gate of the third transistor, buffer, or driver 18 is connected to the input port or collector of the bipolar comparator transistor 14 and optionally, further connected through a frequency compensation network comprising a resistor 37 and a capacitor 38 to the bias port or base of the transistor 14 for damping-out high frequency unstable oscillations.

In this common-drain configuration (source follower stage), the third transistor 18 provides a high input impedance, a low output impedance at the buffered gain stage output node 133, and a near-unity voltage gain to be used as an impedance transformer/converter or buffer to prevent the loading of a preceding signal source by the low impedance of the following stage. The amplification gain of the third transistor or buffer amplifier 18 is approximately 0.8. Without the buffer 18, the driving current for the low side switch is directly taken from the high impedance gain or amplification node at the collector of the second transistor 14 which means that the second current source 94 may produce severe distortion to the regulation voltage.

Figure 5:
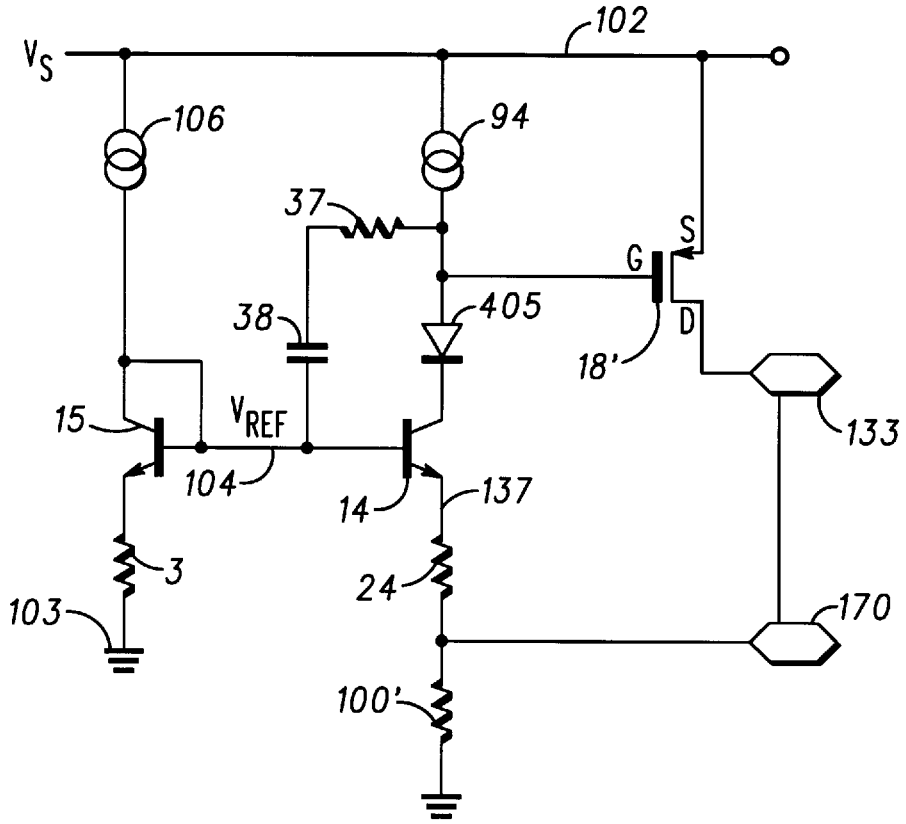
FIG. 5 is a circuit diagram of the control circuit of FIG. 2, in a regulator application, in accordance with the present invention.

For MOS devices, as in the N-channel MOSFET (NMOS) device used as the driver's third transistor 18 and the switch transistor 39 of FIG. 3 or in the P-channel MOSFET (PMOS) device used as the regulator's third transistor 18' of FIG. 5, respectively, the gate voltage refers to the voltage difference between the gate and source nodes. As is known, a MOS device is voltage controlled and the gate of a MOS device is basically a capacitor. Preferably, the third amplifier 18 is realized as a large N-channel metal oxide semiconductor field-effect transistor (N-MOSFET) NMOS to eliminate offset currents from being introduced by the second current source 94. The fourth transistor 39, also preferably NMOS, provides a low ON-resistance when its gate voltage is sufficiently high to turn the transistor ON. If desired, a mixed-signal power process may be used to build MOS and power devices on top of a bipolar process which is commonly termed as the BIMOS process.

The transistor type chosen as the fourth transistor switch 39 will predetermine the minimum voltage or lower limit of the regulation voltage VREG because the input node of the fourth transistor 39 (drain of a MOS for providing Vds and collector of a bipolar for providing Vce) is the actual node desired to be regulated and that is connected to the regulation voltage node 170. MOS devices are preferred over bipolar devices as used in switches because bipolar devices have a built-in saturation voltage (nominally around 0.3V) that will introduce a regulation voltage (VREG) error if this saturation voltage is comparable with the voltage desired to be regulated. This approximately 0.3V saturation voltage in a bipolar device can not be eliminated no matter how large a bipolar switch is used and how large a base current is provided. Hence, if the regulation voltage VREG is desired to be 0.7V, a Darlington pair can not be used since the lower VREG limit of the Darlington pair would have to be at least Vbe+Vsat=1V. Similarly, if the regulation voltage VREG is desired to be less than 0.3V, a bipolar junction transistor can not be used either since the lower VREG limit of the bipolar device would nominally have to be at least Vsat=0.3V.

On the other hand, unlike a bipolar device, a 0V saturation voltage can be theoretically achieved for a MOS switch. The saturation voltage for a MOS device depends on the gate voltage. In general, the higher the gate voltage, the lower the minimum saturation voltage can be. The saturation voltage of a MOS device is inversely proportional to the device geometry and the applied gate voltage. It is also proportional to the device channel length and drain current Id. Thus to bring down the saturation voltage of a MOS switch, the device geometry can be made as large as possible, for example with a wide gate width and a very short gate length to form a very short channel length and by applying a high voltage at the gate. Theoretically, the saturation voltage can be zero if an ultra-large power MOS switch is used to shut down a tiny application loading current I because both the drain current I and ON-resistance R are very low in a large power N-MOS to provide a low drain-source voltage Vds= IR and a subsequent low saturation voltage.

However, if the device is large enough to provide sufficient application loading current and the desired regulation voltage VREG is not limited by the saturation voltage Vsat, the low-side switch 39 can be either an NMOS or a bipolar transistor. If the loading current is large, the fourth transistor 39 could be a power transistor, in the form of a large N-MOS device capable of handling large currents and having low ON-resistance, a bipolar junction transistor for a regulated voltage above approximately 0.3V, or a Darlington pair for a regulated voltage above approximately 1.0V.

As is known, ordinary MOS have high ON-resistance R because they are small in size, while power MOS in large sizes have low ON-resistance R. Since the drain-source voltage Vds=IR, to keep the drain-source voltage Vds, and subsequently, the saturation voltage low, if the drain current or loading application current is large, the ON-resistance R must be low and hence the use of a large MOS.

On the other hand, if the application loading or drain current I is already low, a relatively higher ON-resistance R could be used to still maintain a similar low Vds. Hence, if the loading current is small, transistor 39 can be an ordinary MOSFET such as a small N-MOS device which has a high ON-resistance R.

Regardless of which, low side drive means that the drive is for the transistor 39 having a source or emitter that is connected to the common ground potential node 103. Conversely, high side drive means that the drive is for a transistor whose drain or collector is connected to the external supply node 160. When the low side drive switch 39 is turned ON, its output is connected through a low impedance path (i.e., the switch itself) to the negative rail 103. A high side switch, on the contrary, when turned ON, will connect the output to the positive rail 102 through a low impedance path.

By way of the resistor 24 at the output terminal or node 170, the input port or drain of the low-side switch 39 is connected to the emitter of the common based bipolar junction transistor 14. If the coupling or high-side active drive transistor device 18 is large enough, it will have a sufficiently low ON-resistance, such that when the driver 18 needs a high gate voltage or a high base current for the transistor 14 to cover a load 100 drawing a heavy load current, the internal supply rail from the external supply node 160 can provide this through the low impedance path through the transistor 39. Such a load condition can exist when a heavy inrush transistor gate current from the third transistor 18 is used to bring the load up to the regulated output voltage VREG. A high gate current drain results from the power source supplying power to the voltage control circuit through the load current whenever the load condition at the output of the voltage control circuit exhibits such a low impedance.

The voltage control circuit of the present invention maintains the output voltage even for regulated voltages below 0.7V. At the output port or emitter of the second amplifier 14, a feedback voltage can be detected at a feedback node 137. This feedback voltage is a representative of the output voltage at the output terminal 170 and its feedback node is in a feedback loop to maintain the feedback voltage at a value equal to a predetermined voltage drop developed across the resistor 24 due to the current flow set by the second current source 94. This feedback loop will maintain the output voltage at a predetermined design value even in the event of a change in the effective load resistance of the load attached to the output node 170. In effect, transistor 14 forms a voltage comparator using transistor action in a common-base configuration.

Because the output of the feedback circuit is a voltage, the resultant comparator loop is affected by voltage variations in the loop amplifier temperature operating point and hence needs self-regulation or compensation provided by the teachings of the present invention. In general, for achieving internal feedback for either the regulator or driver switch application, the third amplifier 18 varies the mirrored current flowing into the input port or collector of the second amplifier 14 substantially in proportion to a voltage difference sensed at the output terminal 170 between the output terminal voltage and the temperature compensated and regulated voltage VREG so that the voltage characteristic Vbe14 of the second amplifier 14 between the receiving port or base bias input and the output port or emitter of the second amplifier 14 decreases with an increase in the output terminal voltage over the temperature compensated and regulated voltage VREG. The second port of the third amplifier 18 receives a remainder portion of the mirrored current not flowing into the input port or collector of the second amplifier 14. In response to this increase in the remainder portion of the mirrored current sensed at the second port, the third port of the third amplifier 18 proportionately provides a third port signal for proportionally varying the output terminal voltage at the output terminal until equilibrium is reached with the temperature compensated and regulated voltage VREG.

In the switch driver application, the voltage control circuit thus uses the third amplifier 18 as a buffered driver coupled to and for controlling the second amplifier 14. The second amplifier 14, acting as a sensing comparator, affects the collector current into its collector input in response to a buffered representative of the error. By this transistor action, the second amplifier 14 causes the buffer/driver 18, to act upon the output element in the form of the switch 39 coupled to the driver 18 for generating and regulating the output voltage in response to the buffered error signal. An externally supplied load, simply represented as resistor 100, is coupled through the output terminal or node 170 to the emitter of the transistor 14, via the intervening emitter resistor 24, and is further coupled to the output or source of the transistor 18 for affecting the collector current of the transistor 14 in response to the output voltage sensed at the external output feedback regulation node 137 derived from this load voltage drop.

Since the low-side switch 39 is voltage driven at the gate bias port and by the impedance of the switch 39 control line which is resistive (100), the output current from the transistor 18 will automatically generate a control bias port voltage to drive the voltage driven switch 39. Transistor 14 regulates the amount of gate current supplied to transistor 18, and thus the voltage at the output terminal 170 which is also the drain input of the transistor 39. In this manner, the feedback output voltage reference node 137 at the emitter of the transistor 14 provides the control circuit's negative feedback which stabilizes the circuit operation.

In either the driver or the regulator case, as the supply voltage is applied across the supply nodes, the bipolar base-coupled pair of transistors 15 and 14 turn ON, thus drawing current through the transistor 39. Current is also supplied by the transistor 14 to the gate of the transistor 18, which begins to turn ON. Output voltage at the output terminal node 170 begins to rise until it hits its predetermined design value, at which point it stabilizes.

During steady state and majority of the time, the second transistor 14 operates with the magnitude of the base input current being within a linear range of base current magnitudes for providing a linearly-related collector current. This linearly-related collector current is applied to the bias input of the third amplifier 18 for linearly adjusting the output of the third amplifier 18 in relation to the bias input to thereby maintain a desired amplifier output signal VREG in response to an about equal signal condition when a representative of the feedback voltage is the same as a representative of the reference voltage. This steady-state situation should be happening most of the time by operating transistor load design to ensure that the collector current would not be diverted and all of the collector current is applied to the collector of the transistor 14.

At equilibrium, when the output voltage at the output node 170 is exactly equal to the desired 0.7V, for example, the second transistor 14 is operating in the bipolar linear or active region, the second current source 94 is conducting, and the base-emitter voltage of the second transistor, applying equation 1, satisfies the following equation relating to the saturation current Is:

$$Vbe14=VTIn(I94/Is) \quad (7)$$

The third transistor 18 is also operating in the corresponding saturation or active region after it has been charged to a voltage that is sufficiently high.

If the fourth transistor 39 is implemented as a bipolar transistor, the gate voltage to the third transistor 18 has to be high enough to supply the current required from its output node 133 to ground for turning ON the bipolar fourth transistor. Preferably, the bipolar fourth transistor is supplied through a pull-down resistor 403 at the output node 133 of the third transistor 18 coupled to the ground potential 103. If the output terminal node 170 is set below 0.7V, the bipolar fourth transistor that is a single stage bipolar device (not a Darlington pair), operates in the left ramping saturation or resistive region of the operating curve.

Similarly, the fourth transistor 39 operates in the equivalent left ramping portion of the operating curve (ohmic/linear/resistive region) if the fourth transistor 39 is a MOS device. A regulated voltage VREG of less than 0.7V would provide a Vds of also less than 0.7V which is quite low compared to the gate voltage (nominally greater than 4V) of the MOS transistor 39. Hence, device 39 should be expected to be working in the resistive/linear/ohmic region. However, no current flows into the fourth transistor 39 if it is a MOS device. Instead, the gate of the fourth transistor 39 will be charged sufficiently high such that it can drive the voltage at the output terminal node 170 to the required voltage VREG of equation 4 where Vds=VREG.

At equilibrium, no current should flow to the gate of the third transistor 18 to change its gate voltage. However, no gate current does not mean that the third transistor 18 is turned OFF because its gate capacitance has already been fully charged to the desired voltage. Hence, the third transistor 18 remains ON even though there is no more gate current flowing into it, reasonably assuming that the gate leakage current is negligible in the MOS application.

The voltage at the third transistor output node 133 is determined by a feedback mechanism for settling the node 133 at a voltage such that the fourth transistor 39 can drive the output node 170 to the regulation voltage VREG of equation 4. Since nodes 170 and 133 are in the same phase, the voltage at node 133 increases (or decreases) with the voltage at node 170, acting as an amplified or buffered error signal between the actual voltage at node 170 and the desired regulated voltage VREG. So a correction voltage at node 133 follows the following equation for the driver switch application:

$$V(133)=\{V(170)-I94(R3-R24)\}A1A2 \quad (8)$$

In equation 8, A1 is the gain of the regulator and approximately equals to the transconductance of the second transistor 14 multiplied by the output impedance of the second current source 94. The transconductance of the second transistor is:

$$gm14=I94VT \text{ where } VT=kq/T \quad (9)$$

Wherein: k is the Boltzmann constant, q is the electronic charge, T is the absolute operating temperature.

In equation 8, A2 is the gain of the fourth transistor 39. It the fourth transistor 39 of the switch driver application is bipolar and working in the linear or active region, A2 would be higher than it would be if it were working in the resistive (saturated) region. Likewise, a MOS transistor 39 working in the active/saturation region would have a higher gain than in the linear/ohmic/resistive region. Hence, care should be taken to design an appropriate compensation network, such as a resistive (37) capacitive (38) network, to prevent oscillation. Alternatively, if the fourth transistor 39 is a bipolar device working below 0.7V in the saturation or resistive region, the only difference is that the gain of the fourth transistor A2 will decrease to result in a lower open loop gain. Such a low loop gain feedback mechanism is preferred because it is less susceptible to oscillation and dissipates less heat.

Equilibrium is achieved when the collector current supplied to the second transistor 14 exactly equals the collector current needed by it. This current balance implies two conditions. First, at equilibrium, no more current from the second current source 94 will flow to the gate of the third transistor 18. Second, the voltage at the output node 170 will equal the voltage VREG of equation 4.

However, if the output voltage at the output node 170 slightly rises, above the regulated or desired voltage VREG, set by equation 4, the resultant voltage at the emitter or feedback node 137 of the second transistor 14 also rises because the base-emitter voltage of the second transistor 14 VbeQ14 is reduced. The second transistor 14 becomes less turned ON because while the voltage at the base node 104 is fixed by the internal voltage reference signal by equation 2, the emitter voltage has increased in response to the output voltage increase to reduce the voltage difference between the emitter and base nodes or the baseemitter voltage. Less collector current flows through the second transistor 14 because of the proportionately reduced base-emitter voltage according to its general bipolar transistor characteristic Vbe14=VTln(lc/ls) of equation 1. Therefore, some of the current from the second current source 94 is diverted from the collector input into the gate of the third transistor 18.

This sensing bipolar junction transistor 14 will then sink less current to the resistor 24 because the base-emitter voltage of the common based bipolar junction transistor 14 has been reduced by the rising emitter voltage. The excess current from the second current source 94 originally flowing to the common based bipolar junction transistor 14 will no longer flow to that transistor 14, but flow to the third amplifier 18.

In the switch driver application specifically, the excess current will flow into the gate of the low-side driver or buffer 18, to increase the bias signal or gate voltage of the third amplifier 18 until the output voltage has dropped and re-stabilized. With the increase in gate current, the third transistor 18 is turned ON harder to provide more current at the third transistors output node 133 for supplying the gate of the fourth transistor 39 if it is a MOS device, or the base of the fourth transistor if it is implemented as a bipolar transistor instead. The increased gate current charges up the gate capacitor voltage (gate voltage is the difference between the gate node and the source output at the node 133) of the NMOS transistor 18 and turn it ON harder. Subsequently, the fourth transistor 39 is turned ON more to drive down the voltage at the output node 170. Hence, the higher source voltage output at the node 133 will turn ON the fourth transistor 39 harder such that more current flow through the load 100 and therefore the voltage at the output node 170 drops until equilibrium is reached.

The feedback is operated vice a versa if the output voltage is too low. If the fourth transistor 39 is a bipolar device, it may operate in the linear region depending on the regulation voltage VREG. The bipolar fourth transistor will be saturated only if the output terminal node 170 is below the desired approximate 0.7V. If the bipolar fourth transistor is saturated because the voltage at the output terminal node 170 is below the desired approximately 0.7V for the minimum base-emitter turn-ON voltage, the feedback compensation process forces the voltage at the output node 170 to come back to 0.7V.

Specifically, when the output voltage at the output node 170 decreases, VbeQ14 increases because the input bias voltage VREF is fixed at the base node 104 but the emitter voltage, representative of the output voltage has decreased. The second transistor 14 draws more collector current because the collector current is directly related to the base emitter voltage Ic=Is * exp(Vbe/VT) or Vbe14=VTln(lc/ls) of equation 1. However, since the second current source 94 is a fixed current source, it cannot supply more current than at equilibrium. Hence, the gate of the third transistor 18 is discharged (gate voltage decreases). The consequence of the discharge is that the third transistor 18 is forced to provide less electrical drive through the output node 133 to the fourth transistor 39, MOS or bipolar, which means that the voltage at the output node 170 will increase until it reaches equilibrium at the regulation voltage. This feedback compensation process will bring the voltage back to equilibrium no matter whether the output node 170 is higher, lower, or equal to 0.7V as long as the output voltage at the output node 170 is lower than the regulation voltage set by equation 4.

Referring to FIG. 4, the third transistor 18 has to be turned ON and OFF, according to the switching frequency, in order to cut-off the electrical drive to the fourth transistor or low-side switch 39 through the buffered gain stage output node 133 to switch the load 100. Other preferred additions for this switching application are at least a pair of pull-down switches 404 and 433 and a reverse current blocking diode 405. To turn the fourth transistor 39 OFF, the electrical drive at node 133 has to be turned OFF. Hence, the third transistor 18 has to be deactivated by discharging its gate capacitance through a first pull-down switch 404. Besides cutting OFF the drive to the fourth transistor 39, the gate capacitance or the base current of the fourth transistor 39, depending on whether the fourth transistor is a MOS or a bipolar device, has to be discharged or drained to ground through a second pull-down switch 433. A microprocessor control signal Vup is applied as the gate voltage to the pair of pull-down switches 404 and 433 to turn the fourth transistor 39 ON and OFF according to the switching frequency. Similarly, yet another pull-down element can be added at the gate node of the third transistor 18 to prevent the existence of an electrical drive at node 133 during the switch turn-OFF period.

In addition, a blocking diode 405 is preferably inserted between the cathode connected second current source 94 and the anode connected collector of the second transistor 14 to prevent a reverse current from flowing from the external supply Vext node 160 to the ground potential 103. If the fourth transistor 39 is turned OFF and the voltage at the emitter node 137 voltage exceeds that of the base node 104, the second transistor 14 will become a reversed bipolar device where a reverse current can flow from the external supplied node 160 via the load 100 to the ground potential 103 through the pull-down switch 404 and the second transistor 14 if the blocking diode 405 is not there. Hence, the load 100 could never be switched-OFF. With the blocking diode 405 in place, it blocks the reverse current from preventing the load 100 from shutting OFF.

When the fourth transistor 39 is turned ON in the switching application, the circuit acts as a voltage regulator. However, the inventive control circuit can be simplified for use as a regulator for supply regulation.

Referring to FIG. 5, if the inventive circuit is used as a supply voltage regulator for a constant voltage at all times, the electronic load 100 can be more simply connected directly to the combination of nodes 133 and 170 on one end and to the ground potential 103, on the other end, without the need of the fourth transistor 39. A minimum load 100 is required to ensure that the third transistor 18 is constantly turned ON in order to stabilize the voltage at the node 133.

In this supply regulation case, the representative of the detected output voltage at the output terminal is a divider voltage where the emitter elements coupled to the transistor 14 are a resistor 24 and a load resistor 100' for forming the voltage divider.

Similarly, in the regulator application as in the driver switch application, the voltage control circuit uses the third amplifier 18 to control the second amplifier 14. The second amplifier 14, acting as a sensing comparator, affects the collector current into its collector input in response to an amplified representative of the error. By this transistor action, the second amplifier 14 causes the amplifier 18, to act upon the output element in the form of the load resistor 100' in the voltage divider network, coupled to the amplifier 18 for generating and regulating the output voltage in response to the amplified error signal. The emitter of the second transistor 14 is connected to the feedback node 137 of the output divider for receiving a divider voltage proportional to the output voltage of the voltage control circuit.

However, in the regulator application, the third transistor is changed from an NMOS to a PMOS device 18'. As the voltage at the output node 170 increases, the second transistor 14 is less turned ON since the voltage at the base node 104 is fixed as before. Since less collector current now flows into the second transistor 14 despite the second current source 94 being fixed, some of the current 94 not able to flow through the second transistor 14 goes to the gate of the third transistor 18' to charge up the gate voltage. Since it is a PMOS device, the third transistor 18' is less turned ON because the gate voltage in a PMOS is the difference of the voltages at the source and the gate. With less gate voltage available, the third transistor 18' supplies less current and the voltage at the output node 170 drops to the equilibrium point of the regulation voltage VREG since the output node 133 of the PMOS third transistor 18' at the drain is connected to the output node 170. Using PMOS for the third transistor means that the third transistor 18' now is not acting as a buffer but an amplifier because it is in a common source configuration where the input is the gate but the output 133 is the drain and not the source.

In summary, for either controlled turn-ON voltage switching or low voltage regulation control applications, two high-side mirrored current sources 94 and 106, two base-coupled transistors or amplifiers 14 and 15, two resistors 3 and 24 and a third transistor or amplifier forms a self-referenced control signal to drive, regulate, or otherwise control the second transistor 14 such that the regulation voltage can be set at less than 0.7V, even over a wide temperature range, as a function of the resistance and mirrored current source values.

What is claimed is:

1. An integrated circuit self-reference and temperature independent control circuit for controlling the voltage from a supply voltage terminal in an integrated circuit chip, the control circuit comprising:

an integrated circuit reference voltage source for providing an internal fixed high-side amplifier bias at a temperature dependence of a predetermined polarity;

an integrated temperature control circuit compensator having a temperature dependence of the same predetermined polarity and a receiving port for receiving the internal fixed high-side amplifier bias; and an output terminal having an output terminal voltage in a Kirchhoff voltage loop on the chip for subtracting the voltage and temperature dependence of the same polarity across the integrated temperature control circuit from the integrated circuit reference voltage source to provide a temperature compensated and regulated voltage at the output terminal as the output terminal voltage.

2. The control circuit of claim 1 wherein the integrated circuit reference voltage source comprises:

a first impedance element having a first end, a second end, a first value, and a first temperature coefficient; and a first amplifier having an input port, an output port coupled to the first end of the first impedance element, and a bias port for receiving a fixed temperature compensated amplifier bias potential, the input port and the bias port coupled together in a diode configuration to provide the internal fixed high-side amplifier bias as a function of a voltage characteristic of the first amplifier between the bias port and the output port and a voltage developed across the first impedance element.

3. The control circuit of claim 2 wherein the integrated temperature control circuit compensator comprises:

a second impedance element having a first end coupled to the output terminal, a second end, a second value, and a second temperature coefficient for forming an impedance ratio as a function of a temperature coefficient ratio, wherein the impedance ratio comprises the ratio of the first value over the second value and the temperature coefficient ratio comprises the ratio of the second temperature coefficient over the first temperature coefficient for canceling out the temperature dependence; and a second amplifier having an input port, an output port, and the receiving port for receiving the internal fixed high-side amplifier bias potential, the input port for receiving a mirrored current of the fixed temperature compensated amplifier bias potential, and the output port coupled to a second end of the second impedance element for providing a compensation reference as a function of a voltage characteristic of the second amplifier between the receiving port and the output port and a voltage developed across the second impedance element, the voltage characteristic of the second amplifier being substantially equal to the voltage characteristic of the first amplifier.

4. The control circuit of claim 3 wherein the output terminal provides the temperature compensated and regulated voltage as a function of the mirrored current times the quantity comprising the difference in values between the first and second impedances.

5. The control circuit of claim 3 wherein for at least one of the amplifiers, a metal oxide semiconductor field-effect transistor (MOSFET) transistors is provided.

6. The control circuit of claim 3 wherein for at least some of the amplifiers, bipolar transistors are provided whose collector and emitter electrodes replace the input and output ports.

7. The control circuit of claim 3 wherein for at least some of the amplifiers, NPN bipolar transistors are provided whose collector and emitter electrodes replace the input and output ports.

8. The control circuit of claim 3 further comprising:

a first current source derived from a voltage supply and coupled from the supply voltage terminal and the input port of the first amplifier to provide the fixed temperature compensated amplifier bias potential; and a second current source coupled from the supply voltage terminal and the input port of the second amplifier to provide the mirrored current of the fixed temperature compensated amplifier bias potential.

9. The control circuit of claim 8 further comprising a low pass filtering network coupled having a first end coupled to the receiving port of the second amplifier and a second end coupled to the second current source and to the second port of the third amplifier for reducing unwanted oscillation.

10. The control circuit of claim 8 further comprising:

a third amplifier having a first port, a second port, and a third port, the third amplifier for varying the mirrored current flowing into the input port of the second amplifier substantially in proportion to a voltage difference sensed at the output terminal between the output terminal voltage and the temperature compensated and regulated voltage so that the voltage characteristic of the second amplifier between the receiving port and the output port decreases with an increase in the output terminal voltage over the temperature compensated and regulated voltage, the first port coupled to the supply voltage terminal, the second port for receiving a remainder portion of the mirrored current not flowing into the input port of the second amplifier, and the third port, in response to an increase in the remainder portion of the mirrored current sensed at the second port, proportionately provides a third port signal for proportionally varying the output terminal voltage at the output terminal until equilibrium is reached with the temperature compensated and regulated voltage.

11. The control circuit of claim 6 wherein the second amplifier comprise a sensing bipolar junction transistor having a base electrode for forming the receiving port, a collector electrode for forming the input port, and an emitter electrode for forming the output port and for receiving a feedback signal representative of a voltage detected at the output terminal as controlled by the third amplifier, wherein when the feedback signal rises at the emitter node of the sensing bipolar transistor, as a function of a detected voltage at the output terminal rising above the temperature compensated and regulated voltage, the base-emitter voltage of the sensing bipolar transistor would be reduced such that the sensing bipolar transistor will sink less current to the second impedance element and the excess current from the second current source originally flowing to the collector electrode of the sensing bipolar transistor would be diverted to the third amplifier at the second port, in order for the third port of the third amplifier to reduce the feedback signal.

12. The control circuit of claim 10 wherein the control circuit comprises a regulator.

13. The regulator of claim 12 wherein the third amplifier comprises a P-channel metal oxide semiconductor field-effect transistor (P-MOSFET) having a source electrode for forming the first port, a gate electrode for forming the second port, and a drain electrode for forming the third port wherein the drain electrode in response to the increase in the remainder portion of the mirrored current sensed at the gate electrode, proportionately provides a load supply signal forming the third port signal for proportionally reducing the output terminal voltage at the output terminal until equilibrium is reached with the temperature compensated and regulated voltage.

14. The regulator of claim 12 wherein the output port of the third amplifier couples to the first end of the second impedance element at the output terminal and to a load for forming a voltage divider.

15. The control circuit of claim 10 wherein the control circuit comprises a switch driver.

16. The switch driver of claim 15 wherein the third amplifier comprises an N-channel metal oxide semiconductor field-effect transistor (N-MOSFET) buffer having a drain electrode for forming the first port, a gate electrode for forming the second port, and a source electrode for forming the third port, wherein the gate electrode in response to the increase in the remainder portion of the mirrored current sensed at the gate electrode, proportionately provides a drive control signal as the third port signal for proportionally driving down the output terminal voltage at the output terminal until equilibrium is reached with the temperature compensated and regulated voltage.

17. The switch driver of claim 15 further comprising a low-side switch having an input port coupled to the output terminal and to an externally supplied and connected load, an output port coupled to the second end of the first impedance element at a common terminal, and a bias receiving port coupled to the third port of the third amplifier.

18. The switch driver of claim 17 further comprising:

a first pull-down element coupled to the third port of the third amplifier for inactivating the signal during a switch turn-OFF period of the low-side switch;

a second pull-down element coupled to the second port of the third amplifier; and a blocking diode having a cathode end coupled to the output port of the second amplifier and an anode end coupled to the second current source and to the second port of the third amplifier for allowing the externally supplied and connected load to be switched-OFF by blocking a reverse current from flowing from the externally supplied and connected load to the common terminal through the second pull-down element when the externally supplied and connected load is switched-OFF in absence of the third port signal, the voltage at the output port of the second amplifier exceeds the voltage at the receiving port, and the second amplifier is reverse biased.

19. A voltage control circuit for providing a regulated voltage at an output terminal from a supply voltage terminal, the control circuit comprising:

a first transistor having a base, a collector, and an emitter, the base and collector being connected together;

a first resistor coupled from the emitter of the first transistor;

a first current source coupled between the supply voltage terminal and the collector of the first transistor;

a second transistor having a base, a collector, and an emitter, the base of the second transistor being connected to the base of the first transistor;

a second current source coupled between the supply voltage terminal and the collector of the second transistor; and a second resistor having a first end connected to the emitter of the second transistor and a second end connected to the output terminal for providing the regulated voltage.

20. A switch driver for providing a regulated voltage at an output terminal from a supply voltage terminal, the switch driver comprising:

a first transistor having a base, a collector, and an emitter, the base and collector being connected together;

a first resistor coupled from the emitter of the first transistor;

a first current source coupled between the supply voltage terminal and the collector of the first transistor;

a second transistor having a base, a collector, and an emitter, the base of the second transistor being connected to the base of the first transistor;

a second current source coupled between the supply voltage terminal and the collector of the second transistor;

a second resistor having a first end connected to the emitter of the second transistor and a second end connected to the output terminal for providing the regulated voltage; and a third transistor having a gate, a drain, and a source, the drain coupled to the supply voltage, the gate coupled to the second current source, and the source for providing a buffered voltage proportionate to the regulated voltage.

* * * * *